US011002485B2

(12) United States Patent
Peel et al.

(10) Patent No.: US 11,002,485 B2
(45) Date of Patent: May 11, 2021

(54) APPARATUS FOR STIRRING AND METHODS OF STIRRING

(71) Applicant: Altek Europe Limited, Derbyshire (GB)

(72) Inventors: Alan Peel, Derbyshire (GB); Stephen Makepeace, Derbyshire (GB)

(73) Assignee: ALTEK EUROPE LIMITED, Derbyshire (GB)

( * ) Notice: Subject to any disclaimer, the term of this patent is extended or adjusted under 35 U.S.C. 154(b) by 469 days.

(21) Appl. No.: 15/030,362

(22) PCT Filed: Oct. 20, 2014

(86) PCT No.: PCT/GB2014/053127
§ 371 (c)(1),
(2) Date: Apr. 18, 2016

(87) PCT Pub. No.: WO2015/056032
PCT Pub. Date: Apr. 23, 2015

(65) Prior Publication Data

US 2016/0252306 A1 Sep. 1, 2016

(30) Foreign Application Priority Data

Oct. 18, 2013 (GB) ..... 1318482

(51) Int. Cl.
*F27D 27/00* (2010.01)

(52) U.S. Cl.
CPC ..... *F27D 27/00* (2013.01)

(58) Field of Classification Search
CPC ..... F27D 27/00; F27D 15/02; B22D 11/115; B22D 11/122
See application file for complete search history.

(56) References Cited

U.S. PATENT DOCUMENTS

| | | | | |
|---|---|---|---|---|
| 3,826,646 | A | 7/1974 | Karlsson et al. | |
| 4,834,168 | A * | 5/1989 | Nove | B22D 11/122 164/468 |
| 4,940,214 | A * | 7/1990 | Gillespie | C21C 7/0068 261/84 |
| 2015/0151355 | A1* | 6/2015 | De Monte | B22D 11/115 164/451 |

FOREIGN PATENT DOCUMENTS

| | | | |
|---|---|---|---|
| CN | 201589541 | U | 9/2010 |
| CN | 102345023 | A | 2/2012 |
| CN | 202254908 | U | 5/2012 |
| CN | 202547428 | U | 11/2012 |
| CN | 202630712 | U | 12/2012 |
| CN | 203124674 | U | 8/2013 |

* cited by examiner

*Primary Examiner* — Elizabeth Insler
(74) *Attorney, Agent, or Firm* — Norton Rose Fulbright US LLP

(57) ABSTRACT

A method of stirring and apparatus for stirring using electromagnetic stirrer units is provided. The method and apparatus are particularly useful in relation to molten metal stirring. Each stirrer unit is mounted on a moveable carriage so that it can be moved between a first location, a second location and potentially further locations. The same stirrer unit is used to provide stirring at each location, so allowing multiple locations to be stirred but only requiring a single stirrer unit to do so. The method and apparatus also provide convenient connection of air cooling to the stirrer unit.

19 Claims, 4 Drawing Sheets

APPARATUS FOR STIRRING AND METHODS OF STIRRING

This application is a National Stage of International Application No. PCT/GB2014/053127, filed Oct. 20, 2014, and entitled IMPROVEMENTS IN AND RELATING TO APPARATUS FOR STIRRING AND METHODS OF STIRRING, which claims the benefit of GB 1318482.5, filed Oct. 18, 2013. This application claims priority to and incorporates herein by reference the above-referenced applications in their entirety.

This invention concerns improvements in and relating to apparatus for stirring and methods of stirring using electromagnetic stirring and stirrers.

Electromagnetic stirrers are frequently used to stir molten metals in furnaces and other vessels. Hence they can encounter high heat levels are a result of their operating environment and, to varying extents, as a result of their own operation.

Existing approaches using such stirrers generally use a single stirrer for a single location at which stirring is to be provided.

The present invention has amongst its potential aims to provide for stirring at multiple locations using a single stirrer. The present invention has amongst its potential aims to provide a more flexible and adaptable approach to connecting a stirrer to a cooling system.

According to a first aspect, the invention provides a method of stirring, the method including:

a) providing a number of electromagnetic stirrer units, each stirrer unit being moveably mounted;

b) providing a number of locations at which stirring is to be provided by a stirrer unit;

c) providing stirring at a first location from amongst the number of locations using a stirrer unit;

d) providing stirring at a second location from amongst the number of locations using the same stirrer unit, the second location being different to the first location.

According to a second aspect, the invention provides apparatus for stirring, the apparatus including:

a) a number of electromagnetic stirrer units;

b) a moveable mounting for each stirrer unit;

b) a number of locations at which stirring is to be provided by a stirrer unit;

wherein, the apparatus has a first state in which a stirring unit is at a first location selected from amongst the number of locations; and the apparatus has a second state in which the same stirring unit is at a second location selected from amongst the number of locations, the second location being different to the first location.

The first and/or second aspects of the invention may include any of the features, options and possibilities set out elsewhere in this document, including from amongst the following.

The method of stirring may be a method of stirring molten metal. The method of stirring may be a method of stirring aluminium. The method of stirring may be a method of stirring a furnace. The method of stirring may be a method of stirring a ladle, storage vessel, transport vessel, holding furnace. The method may be a method of electromagnetic stirring.

The method of stirring may be a method of stirring using a bottom mounted stirrer. The method of stirring may be a method of stirring using a side mounted stirrer.

The stirrer units may be provided under a location at which stirring is to be provided, and preferably under all the locations at which stirring is to be provided. A stirrer unit may only be provided under one location at a time.

The stirrer units may be provided alongside a location at which stirring is to be provided, and preferably alongside all the locations at which stirring is to be provided. A stirrer unit may only be provided alongside one location at a time.

The number of stirrer units may be 1. The number of stirrers may be more than 1.

A stirrer unit may include one or more of: one or more electromagnetic coils; an housing; a support frame for one or more electromagnetic coils; one or more cooling spaces for instance within a housing.

A stirrer unit may be moveably mounted, preferably by being mounted, on a carriage. The carriage may be provided with wheels. The carriage may move on a continuous surface, for instance a floor. The carriage may move on a limited surface, such as a rail or rails. All the stirrers may be so provided. The carriage may provide the capacity to move the stirrer unit from the first location to the second location.

A stirrer unit may have one or more positions and preferably at least two positions.

A stirrer unit may have a first position. Preferably the first position is used during movement of the stirrer from the first location to the second location and ideally when moving between all locations. The stirrer unit may not provide stirring when in the first position.

A stirrer unit may have a second position. Preferably the second position is not used during movement of the stirrer from the first location to the second location and ideally is not used when moving between any location. The stirrer unit may provide stirring when in the second position.

The stirrer unit may be closer to the carriage when in the first position compared with when in the second position. The first position may be a retracted position. The second position may be an extended position.

One or more elements may be provided to support the stirrer unit on a carriage. The elements may change position and/or dimension and/or orientation to move the stirrer unit relative to the carriage. One or more of the elements may be operated by hydraulics or other systems, such as mechanical systems, for instance screw jacks, may be used.

One or more conduits may be provided to provide fluid communication for a coolant, such as air, to the stirrer unit, particularly a housing thereof. One or more conduits may be provided to provide fluid communication for a coolant, such as air, away from the stirrer unit, particularly way from a housing thereof. One or more conduits may be provided on the carriage.

The stirrer unit(s) may be moveably mounted to allow for travel in a horizontal plane, or a substantially horizontal plane+/−5°.

The stirrer unit(s) may be moveably mounted to allow for travel between a first location and a second location, where the second location is at least 2 metres, potentially at least 5 metres from the first location, preferably at least 10 metres from the first location and more preferably at least 20 metres from the first location.

The number of locations may be more than 2.

Preferably the number of locations at which stirring is to be provided exceeds the number of stirrer units by at least 1.

The first location may be a location adjacent to a first container of molten metal, for instance a first furnace. The first location may be adjacent to the first container by being underneath the container or alongside the container.

The second location may be a location adjacent to a second container of molten metal, for instance a second furnace. The second location may be adjacent to the second container by being underneath the container or alongside the container.

One or more further locations may be provided, with those locations adjacent to further containers of molten metal, for instance further furnaces. The further locations may be adjacent to the further containers by being underneath the containers or alongside the containers.

The first location may be separated from the second location by at least 2 metres, potentially at least 5 metres, preferably at least 10 metres and more preferably at least 20 metres. Two or more of the locations, and potentially all of the locations, may be separated from each other by at least 5 metres, preferably at least 10 metres and more preferably at least 20 metres.

A stirrer unit may be provided under the first location at a first time and may be moved to be under the second location at a second different time. The stirrer unit may be provided under a further location at a further different time. The stirrer unit may be returned to be under the first location again at a still further different time.

A stirrer unit may be provided alongside the first location at a first time and may be moved to be alongside the second location at a second different time. The stirrer unit may be provided alongside a further location at a further different time. The stirrer unit may be returned to be alongside the first location again at a still further different time.

A stirrer unit may be provided at a first level, for instance a first level which is lower than the bottom of the location to which stirring is to be provided. The first level may be provided in a channel, for instance a channel extending under one or more locations where stirring is to be provided. The stirrer unit(s) may move about within the channel between the locations at which stirring is to be provided.

The stirrer unit is preferably in fluid communication with a source of coolant, such as air, when at the first location. The stirrer unit is preferably in fluid communication with a source of coolant, such as air, when at the second location. The stirrer unit is preferably in fluid communication with a source of coolant, such as air, when at each of the locations at which stirring is to be provided. Preferably the source of coolant to the first and second, and preferably each, location is the same, such as a common pump or fan.

Preferably the number of sources of coolant, such as air, is at least one less than the number of stirrer units. A single coolant source may be provided.

The stirrer unit may be in fluid communication with a source of coolant only at the first location and second location and/or each of the locations at which stirring is provided. The stirrer unit may be disconnected from the fluid communication when moving between and/or positioned between the first location and the second location. The stirrer unit may be disconnected from the fluid communication when moving between and/or positioned between the first location and the second location or each of the locations at which stirring is provided. The source of coolant may be fixed in position, particularly relative to the first location and the second location.

The stirrer unit may be in fluid communication with a source of coolant at the first location and second location and/or each of the locations at which stirring is provided, as well as when moving between and/or positioned between the first location and the second location or each of the locations at which stirring is provided. The source of coolant may be moveable in position, particularly relative to the first location and the second location. The source of coolant may be fixed in position relative to the stirrer unit.

In a particular form, the source of coolant may be moveably mounted, preferably by being provided, on a carriage. The carriage may be provided with wheels. The carriage may move on a continuous surface, for instance a floor. The carriage may move on a limited surface, such as a rail or rails. All the sources of coolant may be so provided. The carriage may provide the capacity to move the source of coolant from proximity with or at the first location to proximity with or at the second location. The source of coolant may be on the same carriage as the stirrer unit. The source of coolant may be on a different carriage to the stirrer unit. The source of coolant carriage and the stirrer unit carriage may be releaseably connected to one another, for instance using an element.

The coolant source may be in fluid communication with an interface at the first location, for instance via a first conduit. The coolant source may be in fluid communication with an interface at the second location, for instance via a second conduit. The coolant source may be in fluid communication with an interface at one or more further locations, for instance via one or more further conduits. The first conduit and second conduit and/or one or more further conduits may have common conduit sections and/or separate conduit sections. A single coolant source may be provided for supplying the first location and the second location, and preferably also one or more further locations.

The interface may provide for fluid communication between the coolant source and the stirrer unit when the stirrer unit is at a location. A first interface may provide for fluid communication between the coolant source and the stirrer unit when the stirrer unit is at the first location. A second interface may provide for fluid communication between the coolant source and the stirrer unit when the stirrer unit is at the second location. One or more further interfaces may provide for fluid communication between the coolant source and the stirrer unit when the stirrer unit is at the one or more further locations.

The stirrer unit is preferably in fluid communication with an exit for coolant, such as air, when at the first location. The stirrer unit is preferably in fluid communication with an exit for coolant, such as air, when at the second location. The stirrer unit is preferably in fluid communication with an exit for coolant, such as air, when at each of the locations at which stirring is to be provided. Preferably the exit for the coolant at the first and second, and preferably each, location is the same, such as a common exhaust location.

The exit interface may provide for fluid communication between the stirrer unit at the exit when the stirrer unit is at a location. A first exit interface may provide for fluid communication between the stirrer unit and the exit when the stirrer unit is at the first location. A second exit interface may provide for fluid communication between the stirrer unit and the exit when the stirrer unit is at the second location. One or more further exit interfaces may provide for fluid communication between the stirrer unit and the exit when the stirrer unit is at the one or more further locations.

The exit interface may be on the other side of the stirrer unit to the interface. The interface used at the first location may be the exit interface used at one or more other locations, such as the second location. The exit interface used at the first location may be the interface used at the second location and/or at one or more further locations.

The interface may be provided in the channel. The interface may be provided aligned with the direction of movement of the stirrer unit and/or carriage towards the location where the interface is provided.

The interface may be provided in two parts. One interface part may be provided on the stirrer unit, particularly the carriage therefore. One part of the interface may be provided on a conduit in fluid communication with the coolant source. One part of the interface may be provided at one end of the channel. One part of the interface may be provided in an end wall of the channel.

The exit interface may be provided in the channel. The exit interface may be provided aligned with the direction of movement of the stirrer unit and/or carriage towards the location where the interface is provided.

The exit interface may be provided in two parts. One interface part may be provided on the stirrer unit, particularly the carriage therefore. One part of the interface may be provided on a conduit in fluid communication with the coolant source. One part of the interface may be provided at one end of the channel. One part of the interface may be provided in an end wall of the channel.

The interface may include a seal promoting element. The seal promoting element may be provided on only one interface part. The seal promoting element may be provided on the interface part not provided by the stirrer unit. The interface may include an outlet with a seal promoting element provided around at least a part, and ideally all of, the circumference of the outlet. The seal promoting element may be a compressible material. The seal promoting element may be a resilient compressible material, such as neoprene, with other materials also being suitable. The seal promoting element may have an extent radially about the axis of the outlet and/or axis of the direction of movement towards the interface. The seal promoting element may be retained in a frame.

The exit interface may include a seal promoting element. The seal promoting element may be provided on only one exit interface part. The seal promoting element may be provided on the exit interface part not provided by the stirrer unit. The exit interface may include an outlet with a seal promoting element provided around at least a part, and ideally all of, the circumference of the outlet. The seal promoting element may be a compressible material. The seal promoting element may be a resilient compressible material, such as neoprene. The seal promoting element may have an extent radially about the axis of the outlet and/or axis of the direction of movement away from the exit interface. The seal promoting element may be retained in a frame.

The interface may include a contact surface. The contact surface may be provided on only one interface part. The contact surface may be provided on the interface part provided by the stirrer unit. The interface may include an inlet with a contact surface extending around at least a part, and ideally all of, the circumference of the inlet. The contact surface may be a flange. The contact surface may be a rigid material, such as metal. The contact surface may have an extent radially about the axis of the inlet and/or axis of the direction of movement towards the interface. Preferably the extent is less than the extent of the seal promoting element. The contact surface may be planar, preferably perpendicular to the axis of the inlet and/or axis of the direction of movement towards the interface. The contact surface may be coplanar with the seal promoting element.

The two parts of the interface may provide for fluid communication through the interface when the two parts abut one another. The two parts of the interface may be brought into abutment by the stirrer unit moving to the location from another location.

The two parts of the interface may cease to provide fluid communication through the interface when the two parts cease to abut one another. The two parts of the interface may be removed from abutment with one another by the stirrer unit moving from the location towards another location.

The exit interface may include a contact surface. The contact surface may be provided on only one interface part. The contact surface may be provided on the interface part provided by the stirrer unit. The exit interface may include an inlet with a contact surface extending around at least a part, and ideally all of, the circumference of the inlet. The contact surface may be a flange. The contact surface may be a rigid material, such as metal. The contact surface may have an extent radially about the axis of the inlet and/or axis of the direction of movement away from the interface. Preferably the extent is less than the extent of the seal promoting element. The contact surface may be planar, preferably perpendicular to the axis of the inlet and/or axis of the direction of movement towards the interface. The contact surface may be coplanar with the seal promoting element.

The two parts of the exit interface may provide for fluid communication through the exit interface when the two parts abut one another. The two parts of the interface may be brought into abutment by the stirrer unit moving to the location from another location.

The two parts of the exit interface may cease to provide fluid communication through the interface when the two parts cease to abut one another. The two parts of the interface may be removed from abutment with one another by the stirrer unit moving from the location towards another location.

The interface may provide for fluid communication between the coolant source and the stirrer unit at a location, with the exit interface providing the exit for the coolant from the stirrer unit. At a different location, the exit interface may provide for fluid communication between the coolant source and the stirrer unit, with the interface providing the exit for the coolant from the stirrer unit.

When the interface is providing fluid communication between the coolant source and the stirrer unit, the exit interface may be in fluid communication with an exit conduit. When the exit interface is providing fluid communication between the coolant source and the stirrer unit, the interface may be in fluid communication with an exit conduit.

According to a third aspect, the invention provides a method of connecting an electromagnetic stirrer to a cooling system, the method including 1) providing an interface in fluid communication with a source of coolant, a first part of the interface being provided at a first location;

2) providing a second interface in fluid communication with a source of coolant, a first part of the second interface being provided at a second different location;

3) providing a stirrer unit which includes the electromagnetic stirrer, the stirrer unit including a second part of an interface; and wherein:

the stirrer unit has a first state and a second state;

the stirrer unit is provided at the first location in the first state, the second part of the interface providing fluid communication from the source of coolant to the stirrer unit in the first state; and the stirrer unit is provided at the second location in the second state, the second part of the interface providing fluid communication from the source of coolant to the stirrer unit in the second state.

According to a fourth aspect, the invention provides apparatus for connecting an electromagnetic stirrer to a cooling system, the apparatus including 1) an interface in fluid communication with a source of coolant, a first part of the interface being provided at a first location;

2) a second interface in fluid communication with a source of coolant, a first part of the second interface being provided at a second different location;

3) a stirrer unit which includes the electromagnetic stirrer, the stirrer unit including a second part of an interface; and wherein:

the stirrer unit has a first state and a second state;

the stirrer unit is at the first location in the first state, the second part of the interface providing fluid communication from the source of coolant to the stirrer unit in the first state; and the stirrer unit is at the second location in the second state, the second part of the interface providing fluid communication from the source of coolant to the stirrer unit in the second state.

The third and/or fourth aspects of the invention may include any of the features, options and possibilities set out elsewhere in this document, including from amongst the first and/or second aspect of the invention options.

Various embodiments of the invention will now be described, by way of example only, and with reference to the accompanying drawings in which.

Figure 3A:
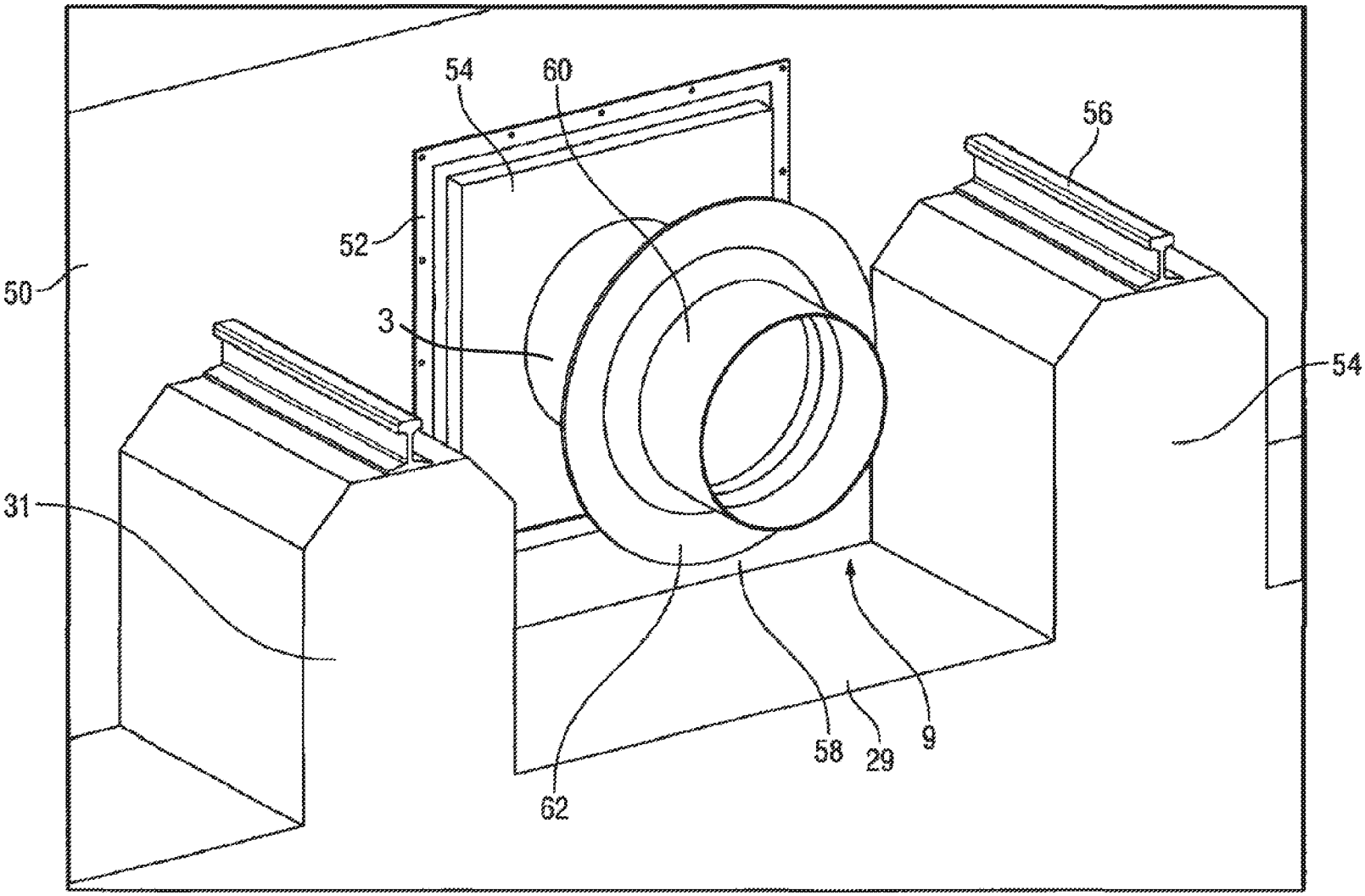
Figure 3B:
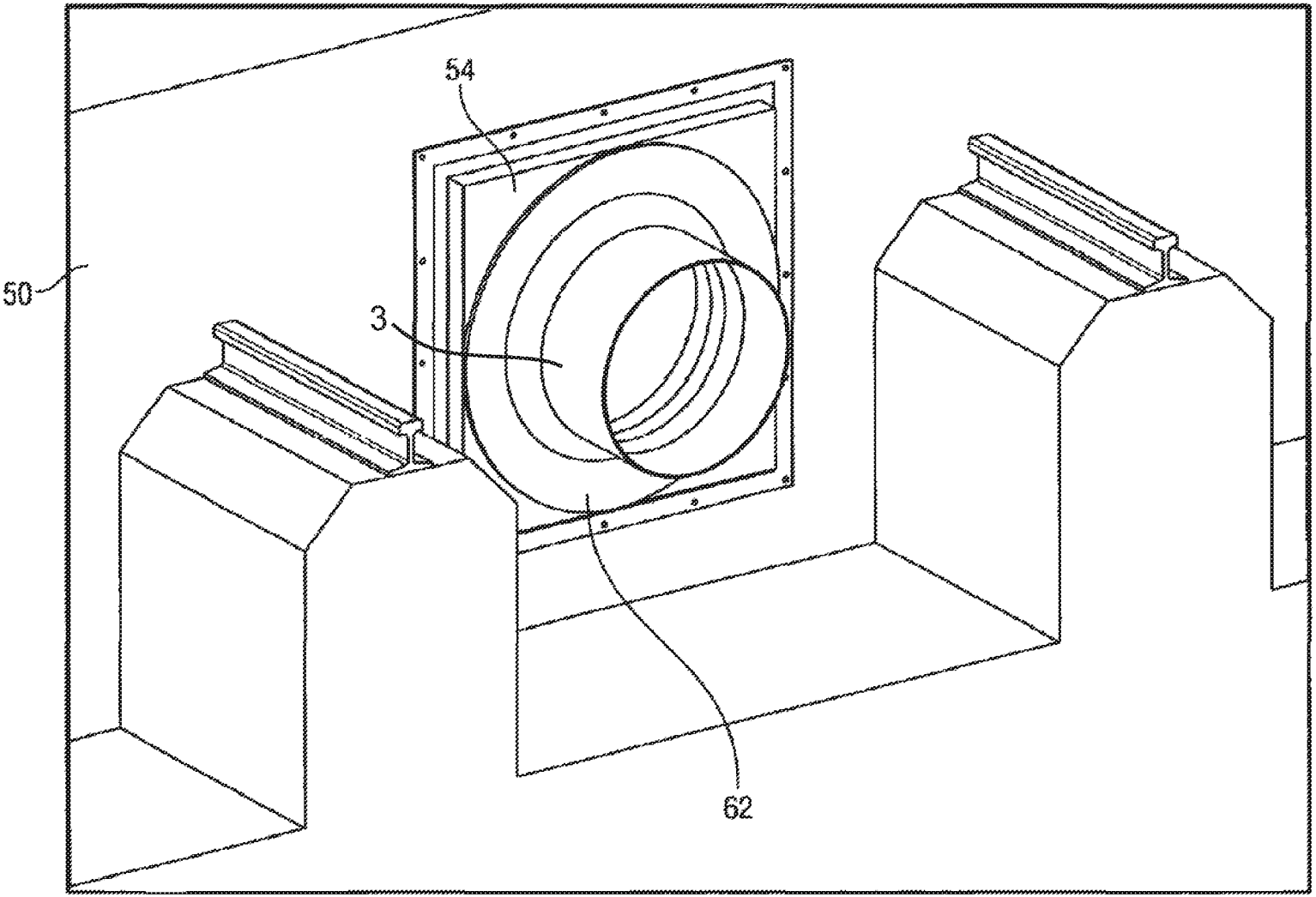

FIG. 3*a* shows the cooling gas connection in a first state;

FIG. 3*b* shows the cooling gas connection of FIG. 3*a* in second state.

Electromagnetic stirrers are known for stirring the molten metal contents of a variety of vessel types, including furnaces, holding vessels, ladles etc. The electromagnetic stirrers are positioned adjacent the vessel and hence are operating in a hot environment and generate internal heat during operation. For this reason, they are often actively cooled, with air being a preferred coolant.

Electromagnetic stirrers are expensive pieces of equipment and are not in full time operation for any one vessel as they are not needed during parts of the molten metal handling cycle.

The applicant proposes in this document a stirring system and stirring method whose approach allows a single electromagnetic stirrer to be used at a number of different stirring locations, whilst conveniently providing cooling at those stirring locations.

Figure 1:
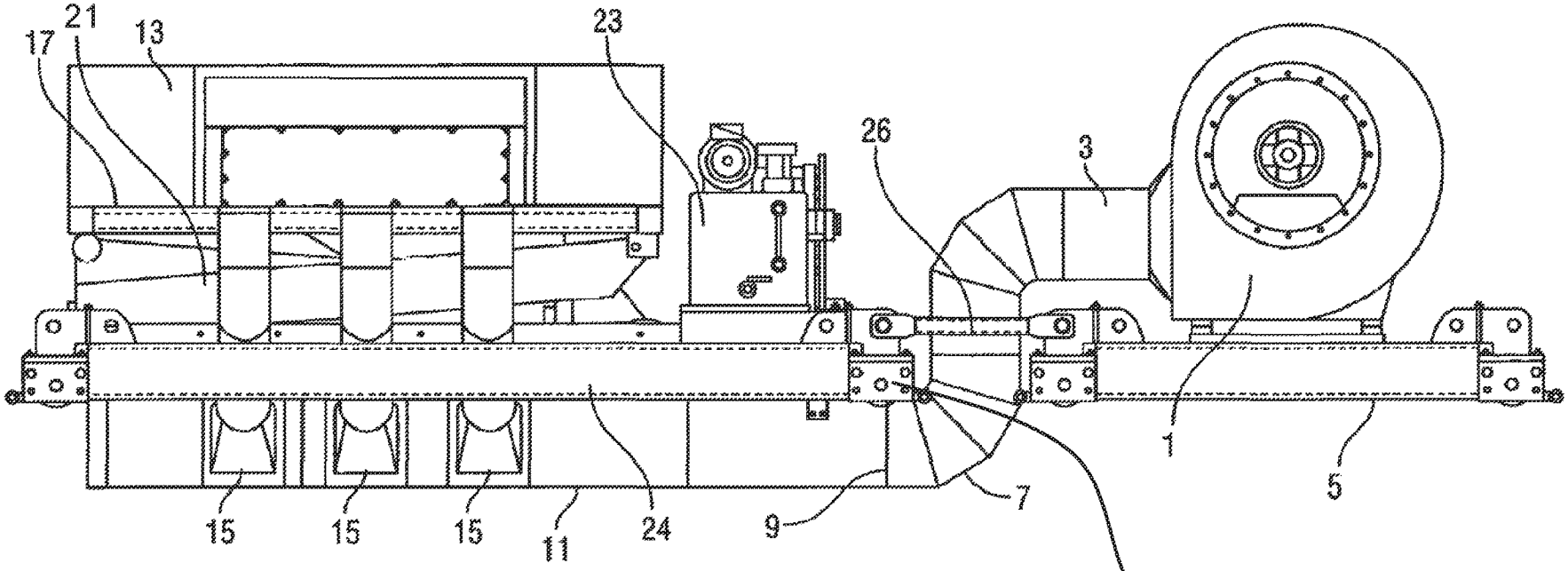
FIG. 1 is a side view of the stirring system in one position.

Referring to FIG. 1, a centrifugal pump or fan 1 for the coolant, in this case air, is provided. The pump 1 draws in filtered air from the environment of the pump 1 and supplies it to an outlet 3. The pump 1 is provided at a first floor level 5 and the outlet 3 conveys the air down to a lower level 7. The outlet 3 ends at an interface 9.

As shown, the interface 9 provides fluid communication between the outlet 3 and the stirrer supply conduit 11. The stirrer supply conduit 11 carries the coolant under the stirrer 13 to three stirrer inlets 15. Each stirrer inlet 15 conveys coolant up into the stirrer 13. Suitable baffles or the like (not shown) are provided to ensure consistent coolant delivery to each stirrer inlet 15. The stirrer inlets 15 convey the coolant into the housing 17 of the stirrer 13 where heat transfer to the coolant provides the necessary cooling effect under the control of suitable internal designs, including baffles and the like.

The heated coolant exits the housing 17 and returns down stirrer outlet (directly behind the inlets in the illustration) and hence into the stirrer supply conduit 11 from where the coolant flows away, to the left-hand side as shown and then out to atmosphere.

In this way the necessary cooling is provided.

As shown in FIG. 1, the stirrer 13 is in the retracted, inactive position. Hydraulics 23 and suitable support arms, potential as a scissor lift, provide the motion to lift the stirrer 13 up and away from the carriage 24 it rests upon. In the elevated position, the stirrer 13 is closer to the furnace (not shown) and so is better able to provide the active stirring position. As the stirrer 13 is lifted, flexible sections of the stirrer inlets 15 allow the required motion. Concertina or bellowed sections or the like can be used for this purpose. Mechanical and other forms of mechanism may be used to provide the motion to the stirrer 13.

The support carriage 24 allows the stirrer 13 to be moved from one location to another location where stirring is required. This allows a single stirrer 13 to be used at multiple locations, rather than have the capital cost of a stirrer 13 at leach of those locations.

At each stirring location the stirrer 13 is provided with air cooling. As described above, this is through connection to a pump or fan 1, and the outlet 3 therefrom. That connection could be made when the stirrer 13 is present at the stirring location and then be broken when the stirrer 13 is moved away from that location. Such a situation would occur if the fan 1 in FIG. 1 was fixed in position, but the stirrer 13 on its carriage 24 was moveable relative to the fan 1; a situation described in more detail below in relation to the FIG. 2, FIG. 3*a* and FIG. 3*b* embodiments.

Alternatively, and as illustrated in FIG. 1, the fan 1 can itself be mounted on a fan carriage 26 which is also adapted for movement and which is connected to the carriage 24 on which the stirrer 13 is provided by a link 28. The link 28 means that as the carriage 24 and its stirrer 13 are moved then the fan carriage 26 and its fan 1 move too. This maintains the connection between the outlet 3 from the fan 1, via the interface 9 to the stirrer supply conduit 11, and allows the air to pass to the stirrer 13. Of course, the link 28 also means that as the fan carriage 26 and its fan 1 are moved then the carriage 24 and its stirrer 13 move too. In a further alternative, not illustrated, the fan 1 can be mounted on the same carriage 24 as the stirrer 13, so that the two move about together.

Figure 2:
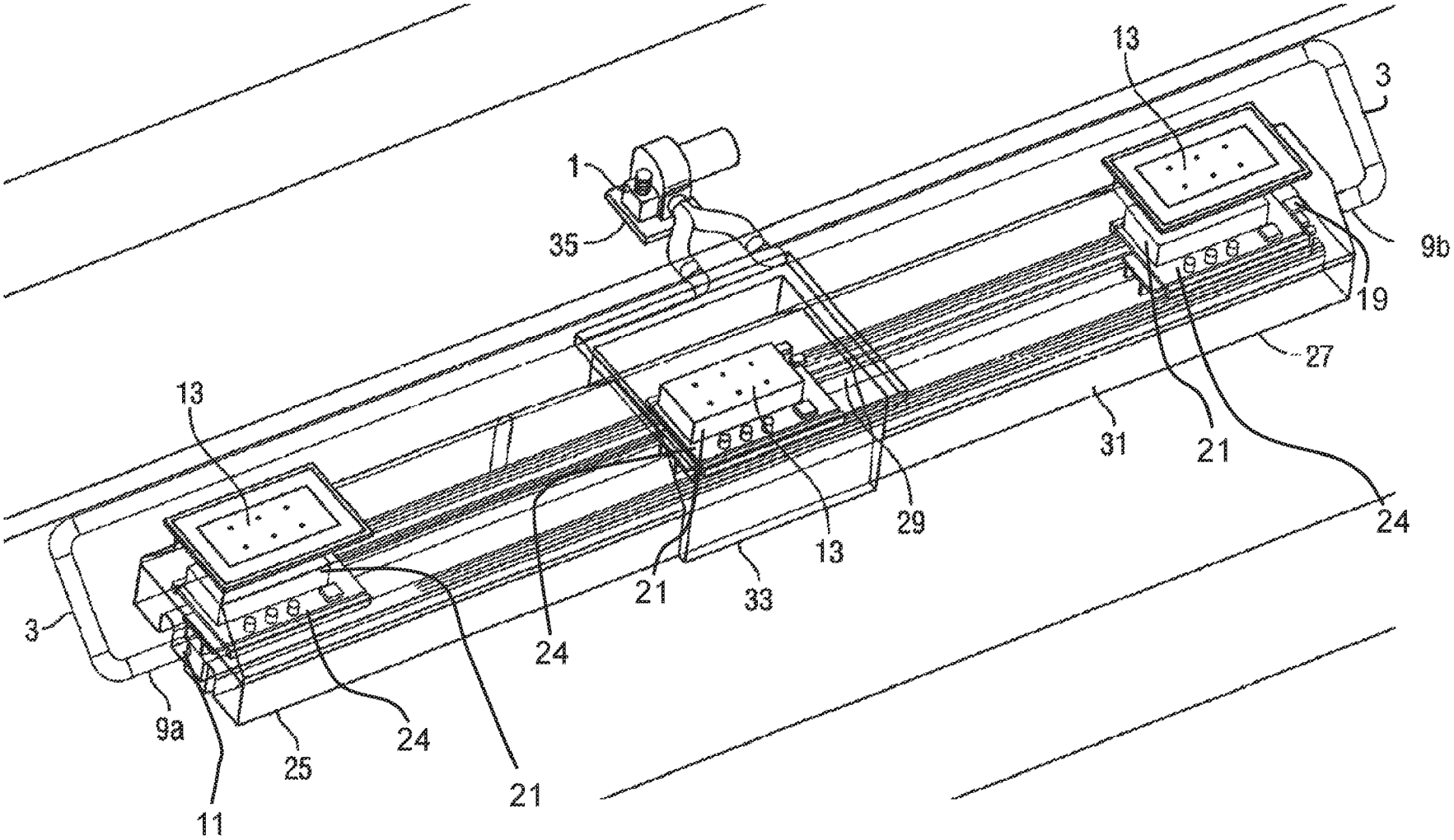
FIG. 2 is a perspective view of a stirring system showing the single stirrer at each of three locations for the purposes of illustration.

In FIG. 2, the general principle outlined in FIG. 1 has been extended to show the use of a single stirrer 13 to provide an active stirring position at a first location 25 and a second location 27. The first location 25 is linked to the second location 27 by means of a channel 29 in the foundations 31 of the plant site. In this case, a linear channel 29 is shown but other channel shapes are possible which accommodate the stirrer 13 and its support carriage 24.

An intermediate position 33 is also provided part way along the channel 29 which allows for easy access to the stirrer 13, hydraulics 19, support arms and carriage 24 for maintenance purposes.

For illustrative purposes the stirrer 13 is shown in FIG. 2 as though it were at all three locations, but in reality only one stirrer 13 is provided in the channel 29.

The single cooling fan 1 at position 35 provides coolant to the outlet 3 as before. In this embodiment, the fan 1 is in a fixed position on the foundations 31. The fan 1 does not move; otherwise the manner of connection is very similar to the FIG. 1 embodiment.

The outlet 3 extends the full length of the channel 29 and goes down into the channel 29 at each end to provide an interface 9*a* for the first position 25 and an interface 9*b* for the second location 27.

In use, when stirring is desired at the first location 25, the stirrer 13 is moved on its carriage 24 along the channel 29 until it is at the first location 25. The movement to the first location 25 connects the stirrer supply conduit 11 to the outlet 3 via the interface 9*a*. This is described in more detail below. With the stirrer 13 at the first location 25, the stirrer 13 can be elevated and the stirring performed for the requisite time. The stirrer 13 can then be taken to the retracted, inactive position, and can then be moved along the channel 29 to the second location 27 to provide stirring there. Again the movement to the second location 27 provides the connection of the outlet 3 via the interface 9*b* to the stirrer supply conduit 11.

As mentioned above, the number of locations at which stirring can be provided can be increased by stopping the stirrer 13 at other locations and/or by providing other channel or rail configurations.

The same general approach can be provided for side mounted stirrers which act through the side walls of vessels, rather than through the base, on the metal contents.

The operation of the interface 9 is shown in more detail in FIGS. 3*a* and 3*b*.

FIG. 3*a* shows the outlet 3 in the end wall 50 of the channel 29, with that end wall 50 being part of the foundations 31 of the plant. The outlet 3 is surrounded by the interface 9 which is formed of a holding frame 52 provided around a square neoprene section 54. Whilst neoprene is a suitable material, a variety of other materials are also suitable to provide the preferred sealing function.

To either side of the outlet 3 are the rail supports 55 and the rails 56 provided on top so as to provide the running surface for the carriage 24 carrying the stirrer 13. In this illustration the stirrer 13 and the carriage 24 have both been omitted, apart from the carriage interface part 58.

The carriage interface part 58 is formed of a cylindrical section 60, which is connected to the stirrer supply conduit 11, together with a metal flange 62.

As shown in FIG. 3*a*, the flange 62 and the neoprene section 54 are spaced apart and so the fluid communication between the outlet 3 and the stirrer supply conduit 11 has not been formed.

Advancing the carriage 24 towards the end wall 50 of the channel 29 reduces and then eliminates the space such that the metal flange 62 abuts the neoprene section 54 and a seal is provided. Coolant can now flow due to the fluid communication provided.

The heated coolant exits the other end of the carriage 24 and can either vent to atmosphere or more desirably be connected to an exhaust interface (not shown in FIGS. 3*a*, 3*b*). The exhaust interface can be separate from or could be the same as the interface at the other location. A conduit extending between the rails 56 and extending the length of the channel 29 could be used, with suitable concertina sections, bellows or the like to accommodate the conduit in reduced or increased length form as the carriage 24 and stirrer 13 move locations.

Any suitable mechanism can be used to move the carriage 24 etc from location to location.

The channel 29 may be formed at the same time as the plant's construction or could be retro fitted.

Instrumentation is provided to confirm that cooling air is flowing and potentially to measure the flow rate thereof.

The invention claimed is:

1. An apparatus for stirring, the apparatus including:

a) one or more electromagnetic stirrer units;

b) a moveable mounting for each of the one or more electromagnetic stirrer units; and c) a support system configured to move each of the one or more electromagnetic stirrer units away from the respective moveable mounting; and wherein, the apparatus has a first state in which one of the electromagnetic stirrer units is at a first location selected from amongst a number of locations and the one or more electromagnetic stirrer units are configured for stirring at that first location; and the apparatus has a second state in which the same one or more electromagnetic stirrer units are at a second location selected from amongst the number of locations and the one or more electromagnetic stirrer units are configured for stirring at that second location, the second location being different to the first location; and wherein the apparatus further includes a coolant source, wherein the coolant source is in fluid communication with a first interface at the first location and the coolant source is in fluid communication with a second interface at the second location, the first interface or second interface provides for fluid communication between the coolant source and the electromagnetic stirrer unit when the electromagnetic stirrer unit is at a location; and wherein the coolant source is provided at a fixed position relative to the first location and the second location.

2. The apparatus according to claim 1 in which the stirrer unit is in fluid communication with the coolant source, the coolant being air, when at the first location.

3. The apparatus according to claim 1 in which the electromagnetic stirrer provides stirring of molten metal, the molten metal being provided in a container, the container being selected from the group consisting of: a furnace, a ladle, a storage vessel, a transport vessel and a holding furnace.

4. The apparatus according to claim 1 in which the electromagnetic stirrer unit is moveably mounted by being provided on a carriage and the carriage provides the capacity to move the electromagnetic stirrer unit from the first location to the second location.

5. The apparatus according to claim 1 in which the electromagnetic stirrer unit has at least two positions, the electromagnetic stirrer unit having a first position, the first position being used during movement of the stirrer from the first location to the second location, and/or the electromagnetic stirrer unit having a second position, the second position being not used during movement of the electromagnetic stirrer from the first location to the second location, the electromagnetic stirrer unit providing stirring when in the second position.

6. The apparatus according to claim 1 further comprising one or more conduits to provide fluid communication for the coolant to the electromagnetic stirrer unit, and one or more further conduits to provide fluid communication for the coolant away from the electromagnetic stirrer unit.

7. The apparatus according to claim 1 in which the number of locations is more than two and/or the number of locations at which stirring is to be provided exceeds the number of electromagnetic stirrer units provided by at least one.

8. The apparatus according to claim 1 in which the electromagnetic stirrer unit is in fluid communication with the coolant source when at the first location and when at each of the locations at which stirring is to be provided, wherein the source of coolant to the first and each location is the same.

9. The apparatus according to claim 1 in which the electromagnetic stirrer unit is in fluid communication with an exit for coolant when at the first location and when at each of the locations at which stirring is to be provided, the exit for the coolant at the first and each location is the same.

10. The apparatus according to claim 1 in which the first interface and/or second interface is provided aligned with the direction of movement of the electromagnetic stirrer unit and/or carriage towards the location where the first interface and/or second interface is provided.

11. The apparatus according to claim 1 in which the first interface and/or second interface is provided in two parts, one interface part is provided on the electromagnetic stirrer unit, and one part of the interface is provided on a conduit in fluid communication with the coolant source.

12. The apparatus according to claim 11 in which the first interface and/or second interface includes a contact surface, the contact surface is provided on only one interface part.

13. The apparatus according to claim 11 in which the two parts of the first and/or second interface provide for fluid communication through the first interface and/or second interface when the two parts abut one another, the two parts of the first interface and/or second interface being brought into abutment by the electromagnetic stirrer unit moving to the location from another location.

14. The apparatus according to claim 11 in which the first interface and/or second interface provides for fluid communication between the coolant source and the electromagnetic stirrer unit at a location, with an exit interface providing the exit for the coolant from the electromagnetic stirrer unit, and at a different location, the exit interface provides for fluid communication between the coolant source and the electromagnetic stirrer unit, with the interface providing the exit for the coolant from the electromagnetic stirrer unit.

15. The apparatus according to claim 1 in which the first interface and/or second interface include a seal promoting element, with the seal promoting element provided on only one interface part.

16. The apparatus according to claim 1 in which the first interface and/or second interface includes an inlet with a contact surface extending around at least a part of the circumference of the inlet, the contact surface having an extent radially about the axis of the inlet, the extent being less than the extent of a seal promoting element.

17. The apparatus according to claim 1 in which the stirrer unit is disconnected from fluid communication with the first interface when moving between the first location and the second location.

18. The apparatus according to claim 1 wherein the support system comprises one or more support arms configured to move each of the one or more electromagnetic stirrer units away from the respective moveable mounting.

19. The apparatus according to claim 18 wherein the support arms are configured for moving the one or more electromagnetic stirrer units in a scissor lift configuration.

* * * * *